United States Patent [19]

Naab

[11] 4,305,693

[45] Dec. 15, 1981

[54] HOISTING/TIPPING OR TIPPING DEVICE FOR EMPTYING CONTAINERS

[75] Inventor: Jakob Naab, Mainz, Fed. Rep. of Germany

[73] Assignee: Zöller-Kipper GmbH, Mainz-Laubenheim, Fed. Rep. of Germany

[21] Appl. No.: 89,518

[22] Filed: Oct. 30, 1979

[30] Foreign Application Priority Data

Oct. 31, 1978 [DE] Fed. Rep. of Germany ..... 2847259
Oct. 23, 1979 [EP] European Pat. Off. ..... 79104094.2

[51] Int. Cl.[3] ..... B65F 3/02

[52] U.S. Cl. ..... 414/411; 414/408; 414/420

[58] Field of Search ..... 414/406, 408, 555, 420, 414/404, 411; 137/625.28, 625.29

[56] References Cited

U.S. PATENT DOCUMENTS 3,738,516 6/1973 Wells ..... 414/406

FOREIGN PATENT DOCUMENTS 243183 10/1965 Austria ..... 414/408
1201756 9/1965 Fed. Rep. of Germany ..... 414/408
1231616 12/1966 Fed. Rep. of Germany ..... 414/411
2515929 10/1976 Fed. Rep. of Germany ..... 414/411
2654542 8/1978 Fed. Rep. of Germany ..... 414/411
942792 11/1963 United Kingdom ..... 414/408

*Primary Examiner*—Robert B. Reeves
*Assistant Examiner*—Gene A. Church
*Attorney, Agent, or Firm*—H. Gibner Lehmann; K. Gibner Lehmann

[57] ABSTRACT

A hoisting and tipping construction, for emptying containers of different sizes, has two individual hoisting and tipping devices arranged side by side, which can be actuated either separately or else together and which are provided with individual pick-up structures each one of which is able to pick up a container to be emptied. Both of the pick-up structures are arranged so that they can simultaneously pick up a single large container. The individual hoisting and tipping devices are equipped with identical pressure-medium motors, connected to identical pressure-medium circuits that are interconnected at their feed lines, which lead from their individual control valves to the motors, through a shut-off or change-over valve that is able to connect the two pressure-medium circuits to each other as desired.

18 Claims, 8 Drawing Figures

34
23
44
43
55b
56b
57b
B
54b
57b
58b
III
I
37b
II
53b
52b
52c
38
P
59
53a
37a
II
I
52
52a
54a
III
58a
A
57a
44
43
55a
56a
57a
34
23

HOISTING/TIPPING OR TIPPING DEVICE FOR EMPTYING CONTAINERS

The present application claims priority under 35 USC 119, of German application No. P 28 47 259.5 filed Oct. 31, 1978; and European application No. SN 79104094.2 filed Oct. 23, 1979.

The invention relates to a hoisting/tipping or tipping device for emptying containers of varying size, in particular for emptying refuse containers of varying size into collecting containers of refuse vehicles, wherein two individual hoisting/tipping or tipping devices are provided side by side, which can be actuated separately or together, as desired, by means of pressure medium-operated motors via valve controls, and the pick-up devices of which are designed and arranged so that they together pick up a container by means of the two individual hoisting/tipping or tipping devices.

It is known to provide a hoisting/tipping device on refuse collection vehicles with two-part clamping devices of the same type, which are provided at a distance from one another and which, with respect to their position and design, correspond to holding elements on a large-capacity and a small-capacity dustbin carrier, one two-part clamping device being envisaged in each case for one small dustbin carrier and the two clamping devices together being envisaged for a large dustbin carrier (German Patent Specification No. 1,231,616). In this known device, all the clamping devices are fitted on a common hoisting slide with a swivel basket. As a result, it is impossible to use these clamping devices independently of each other for emptying small refuse vessels or dustbin carriers. Rather, it is necessary to actuate the hoisting slide with the swivel basket and all the clamping devices for each working step, regardless of whether these clamping devices are all used or not.

A dumping-in device for emptying refuse vessels into refuse collecting containers is also known, wherein two hoisting/tipping devices are fitted side by side, the pick-up devices of which are suitable for the purpose of picking up and emptying a large container by means of the two hoisting/tipping devices together. In the known device, however, a special coupling is to be inserted for this case between the two hoisting/tipping devices (German Offenlegungsschrift No. 2,654,542). For such a case, this special coupling is intended to be, above all, a coupling and carrying beam which is to be mounted temporarily on the two hoisting/tipping devices, or it is intended to be an automatic hydraulic clutch which is to be switched in temporarily. In the former case, the transition from the emptying of relatively small containers to the emptying of large containers necessitates considerable assembly work which cannot be carried out on the road and within the cycle of emptying refuse vessels. The second possibility, namely the use of an automatic hydraulic clutch, is expensive and too prone to faults in the rough-and-ready operation during the emptying of containers, in particular in the case of refuse collecting.

Finally, a hoisting/tipping or tipping device for emptying refuse containers of varying size is also known, wherein likewise two individual hoisting/tipping devices or individual tipping devices are arranged side by side in such a way that each individual hoisting/tipping device or individual tipping device can be used independently of the other for emptying relatively small containers, whilst the two individual hoisting/tipping devices or individual tipping devices can be employed together for emptying relatively large refuse vessels (German Offenlegungsschrift No. 2,515,929). In this case, valve controls are to be provided which, for dumping the relatively small containers, permit a mutually independent, separate actuation of each individual hoisting/tipping or tipping device and, for dumping the large containers, simultaneously feed both the piston/cylinder units of the two hoisting/tipping or tipping devices. This simultaneous, common feeding of the piston/cylinder units of the two individual hoisting/tipping devices or individual tipping devices requires, however, expensive hydraulic control installations in order to ensure synchronous running of the two individual hoisting/tipping devices or individual tipping devices.

By contrast, it is the object of the invention to provide a hoisting/tipping device or tipping device of the type mentioned at the outset, which makes it possible to operate each individual hoisting/tipping device or tipping device separately and mutually independently, as desired, and to operate the two individual hoisting/tipping devices or individual tipping devices together, without the need for expensive synchronous running controls for this purpose. In addition to having a simple safe mode of operation, the device should here also be distinguished by high reliability in each of the two possible modes of operation and by a particularly economical procedure.

According to the invention, this object is achieved when the two individual hoisting/tipping devices or individual tipping devices are equipped with identical pressure medium-operated motors, in particular motors of identical design size, which are connected to two identical pressure medium circuits which each contain a control valve fitted out for the neutral position, pressure stroke and return stroke, and when these two pressure medium circuits can be switched parallel to each other, as desired, via a shut-off valve in their pressure medium feed lines leading from the control valves to the pressure medium-operated motors.

The invention is based on the surprising discovery that, with the same design of the pressure medium-operated motors and with identical construction of the pressure medium circuits, the two individual hoisting/tipping devices or individual tipping devices effect an automatic compensation when relatively large containers are lifted and tipped in. Above all, it has been found, surprisingly, that synchronous running of the two individual hoisting/tipping devices or individual tipping devices in the device according to the invention is ensured during the lifting and tipping of relatively large containers, even if the load distribution on the two individual hoisting/tipping devices or individual tipping devices is not uniform. This even applies to the picking-up, lifting and tipping of relatively small and relatively light vessels and, in particular, also to the tipping-back and setting-down of the emptied vessels. The change-over of the device according to the invention from individual operation to common operation of the individual hoisting/tipping devices or individual tipping devices can be carried out by means of a single shut-off valve. The size of the containers to be emptied is virtually limited only by the size of the opening for dumping, and any conceivable intermediate sizes of containers to be emptied are also included. With the device according to the invention, it is also possible—if required—to grip, and to empty, relatively small vessels with both individual hoisting/tipping devices or individual tipping devices together. This can be important if relatively small vessels with unusually heavy contents are to be emptied.

To ensure uniform pressure conditions and working conditions of the two individual hoisting/tipping devices or individual tipping devices in the end position, both in individual operation and in common operation, the invention can also be developed further in such a way that one pressure compensation valve is provided in each of the pressure medium feed lines, leading to the pressure medium-operated motors, of the pressure medium circuits, which pressure compensation valve is actuated in the tipping-in end position of the particular individual hoisting/tipping device or individual tipping device. When a hydraulic pressure medium system is used, each of these pressure compensation valves can connect the particular pressure medium feed line to the pressure medium return line of the particular pressure medium circuit.

When a hydraulic pressure medium system is used, it is also advantageous within the scope of the invention to cause the control valve of each pressure medium circuit to short-circuit, in its neutral position, the pressure medium forward line, coming from the pressure medium source, in the particular pressure medium circuit to the pressure medium return.

When a hydraulic pressure medium system is used, it is also advisable to make the mutual adaptation of the conditions, provided and achieved according to the invention, in the two pressure medium circuits even better and more reliable by inserting one return flow valve into the pressure medium return line of each pressure medium circuit and also connecting the pressure compensation valve which may be present and the pressure medium short-circuit line which may be present and comes from the control valve, to this return flow valve. These return flow valves reduce the back pressure in the return lines and thus effect a virtually resistance-free back-swivel motion or lowering motion.

A particularly advantageous, preferred embodiment of the invention provides that, when a hydraulic pressure medium system is used, a pressure medium pump, common to both pressure medium circuits, and a pressure-dependent stream divider are provided, one branch of the stream divider forming the pressure medium source for one pressure medium circuit and its second branch forming the pressure medium source for the other pressure medium circuit. In addition to the uniform pressure conditions and flow rate conditions in the two pressure medium circuits, produced by the pressure-independent stream divider, this special embodiment of the invention has the advantage that, with individual operation of the individual hoisting/tipping devices or individual tipping devices, each of the two pressure medium sources charges one of the pressure medium circuits, whilst, with common operation of the two individual hoisting/tipping devices or individual tipping devices, only one pressure medium source charges the two pressure medium circuits switched together. As a result of this, the working speed, that is to say the hoisting speed and the tipping speed, in individual operation is virtually twice that in common operation. This different working speed is appropriate and desirable with respect to operational safety, with respect to the prevention of unnecessary wear and, above all, also with respect to the size of the particular container to be emptied.

Within the scope of the invention, a common swivel shaft, divided in the middle, can be provided for the two individual hoisting/tipping devices or individual tipping devices, one pressure medium-operated motor, which is designed, for example, in the manner of a swivel drive and is connected to one or the other of the pressure medium circuits respectively, being fitted on each end of this swivel shaft, and a sleeve and journal coupling, which coaxially engages from one part of the shaft into the other part of the shaft, being provided in the middle of the swivel shaft. Coupled with high mutual mobility of the two individual hoisting/tipping devices or individual tipping devices, this arrangement is distinguished by high wear resistance and high load-bearing capacity, both in individual operation and in common operation. Moreover, this results in a simple construction since a third bearing of the swivel shaft at the dumping housing is superfluous. This is because such a third bearing causes particular difficulties and problems since, already during the initial assembly of the device, expensive measures are necessary in order to avoid misalignments between the bearing points. A third bearing becomes particularly problematical, however, if for any reasons changes or repairs have to be carried out on the device. All these difficulties disappear as a result of the mutually engaging, opposite mounting of the two parts of the shaft.

In this embodiment of the invention, a swivel-limiting lever, moving towards a stop, can be fitted on each end of the swivel shaft in the zone of the drive shaft of the particular pressure medium-operated motor. This swivel-limiting lever can at the same time be designed as an actuating device for interaction with the particular pressure compensation valve. For this purpose, an adjustable actuating element which engages the actuating member of the pressure compensation valve can be fitted on the swivel-limiting lever.

For the purpose of reliably avoiding any over-tipping of containers to be emptied in the opening for dumping, it is advantageous within the scope of the invention to place, in the opening for dumping, a resiliently yielding tipping-in back stop for the containers to be emptied, opposite each individual tipping device or individual hoisting/tipping device. This tipping-in back stop can here be designed with levers which are pivotable into the opening for dumping against the action of a spring and are provided with hook-like lower ends, and can be designed at the same time as a lid-opening device for containers having a cylindrically domed lid and lid-actuating elements projecting from the side.

If the device according to the invention is designed as a hoisting/tipping device, it is particularly advantageous to equip each individual hoisting/tipping device with a pressure medium-operated motor, for example a swivel drive, for tipping and with a pressure medium-operated motor, for example a cylinder/piston unit, for actuating the hoisting frame, and to arrange these two pressure medium-operated motors, each belonging to one individual hoisting/tipping device, in parallel in the same pressure medium circuit and to match their working surfaces, subject to the pressure medium, to one another to give the time sequence of their working strokes. This permits a particularly simple pressure medium control which, nevertheless, ensures full operational reliability in the working procedure of the two individual hoisting/tipping devices and also in combined working procedure. In a well-proven manner, the hoisting frame of each individual hoisting/tipping device can here be joined via a four-bar linkage to a swivel arm mounted on the swivel shaft.

For additionally safeguarding the working procedure in a hoisting/tipping device according to the invention, in particular during the jarring step, the hoisting frame can be equipped with a locking pawl which swivels under the action of its mere weight and which, in the tipping-in end position, engages as a locking element on the swivel arm or the swivel shaft. A further complementary safety measure can be taken in a hoisting/tipping device according to the invention inasmuch as a hook for locking during a movement of the vehicle, which hook can latch on the partially lifted hoisting frame, is fitted on the swivel arm of each individual hoisting/tipping device. In this way, the hoisting frame of each individual hoisting/tipping device can be safely held in the raised position while a refuse vehicle moves, even if the pressure medium circuits are in the pressure-relieved state.

A particularly advantageous embodiment of the hoisting/tipping device according to the invention provides that the hoisting frame of each individual hoisting/tipping device is fitted with pick-ups engaging with corresponding elements of the containers to be emptied and that these pick-ups of the two individual hoisting/tipping devices are mutually aligned in the rest position, hoisting end position and tipping-in end position.

Advantageously, the outer end of this pick-up of each individual hoisting/tipping device will be fitted with a lateral projection for centering the containers to be emptied, so that containers to be emptied do not strike the side walls of the opening for dumping.

An illustrative embodiment of the invention is explained in more detail in the following text by reference to the drawing in which:

FIG. 3 shows a device according to FIG. 1 in side view, with a relatively large container tipped in;

FIG. 6 shows a detailed representation of a lever limiting the tipping-in;

Figure 1:
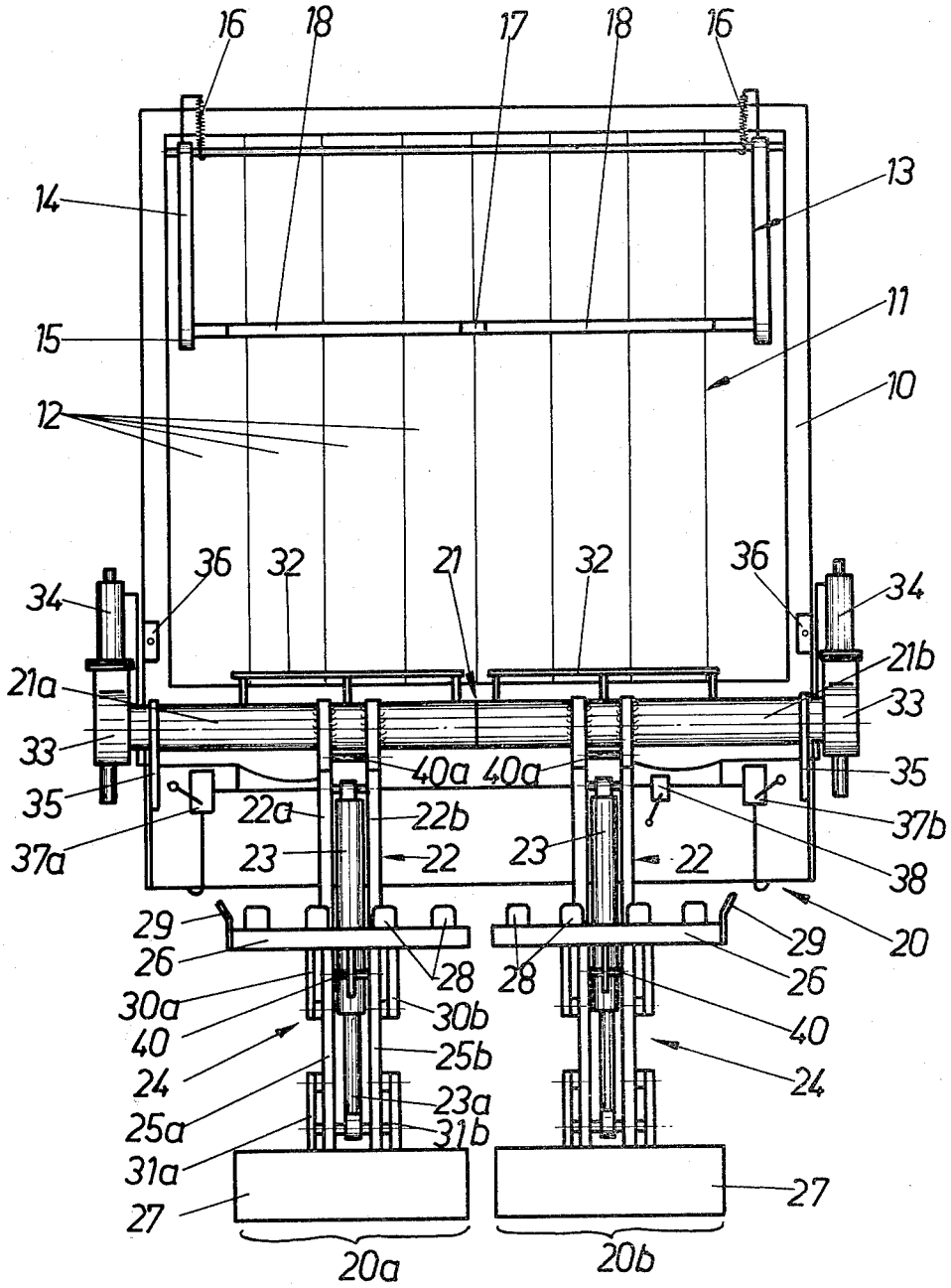
FIG. 1 shows a hoisting/tipping device according to the invention in rear view.
Figure 2:
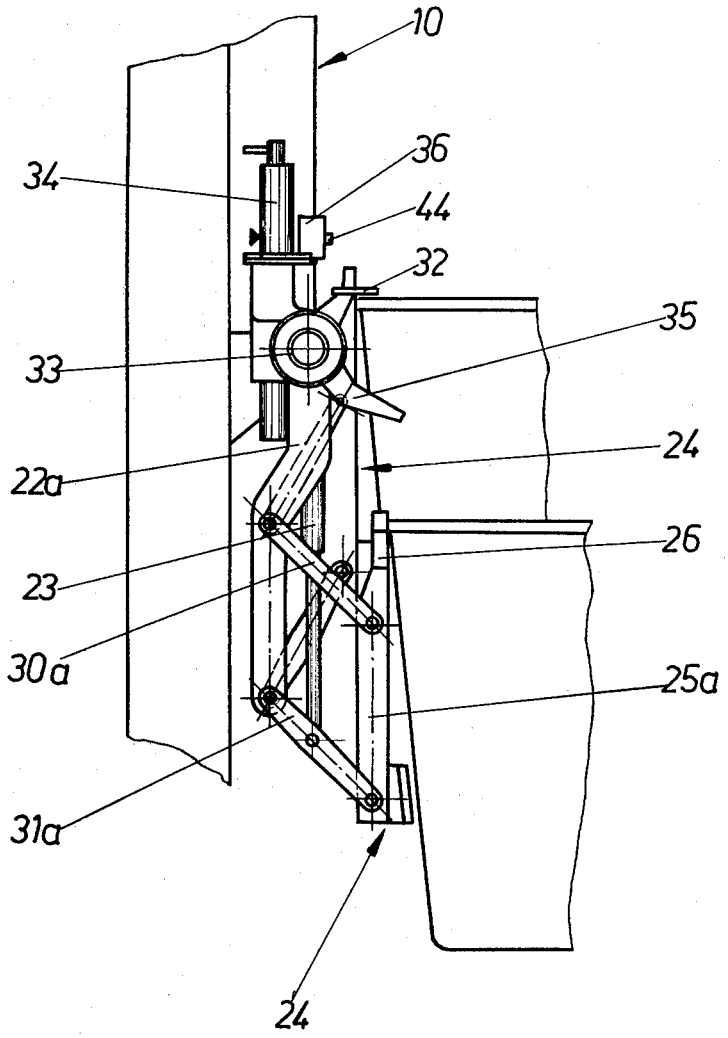
FIG. 2 shows a device according to FIG. 1 in side view, with a container to be picked up and a smaller container raised into the hoisting end position.
Figure 3:
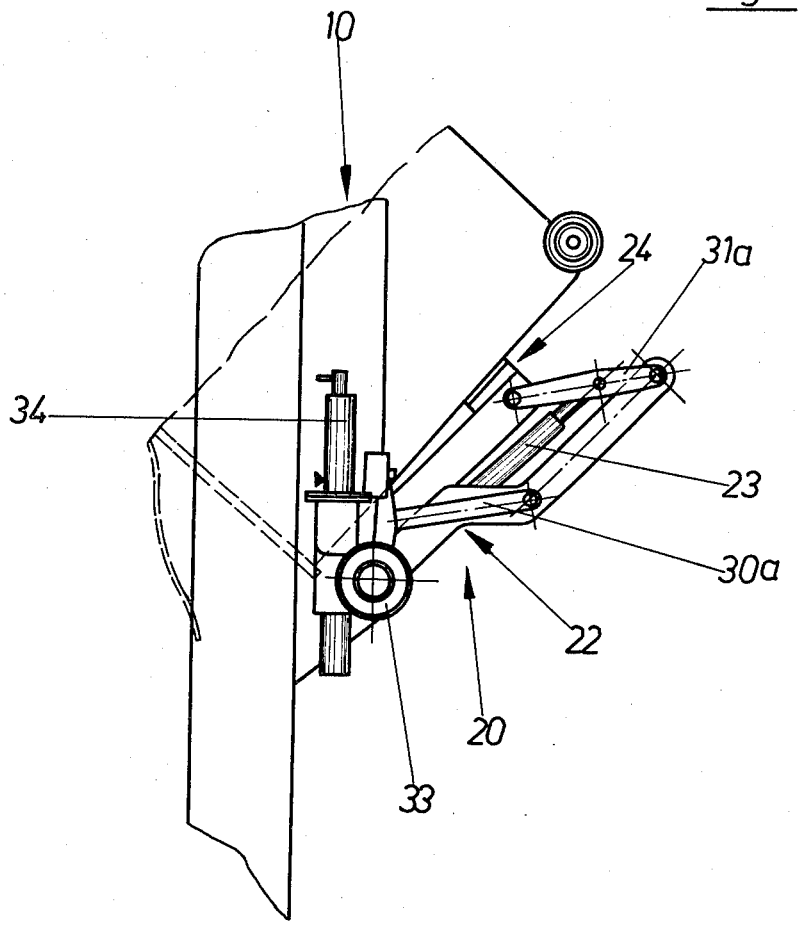

The dumping-in device reproduced in the drawing has a dumping housing 10, of which the opening 11 for dumping can be closed by tarpaulins 12 in the form of strips. In the upper part of the opening for dumping, a lid-opening device 13 is fitted which forms two levers 14 which are pivotably mounted in the upper part of the opening 11 for dumping and have a lower end 15 shaped like hooks. The levers 14 are held in their normal position by springs 16 and their purpose is to pick up actuating pins fitted on the side of the lid of large-capacity refuse vessels and, when the larger-capacity refuse vessel is tipped into the opening 11 for dumping, to hold back the lid of this vessel and hence to open it. In the frame of the novel hoisting/tipping device described in the following text, the two levers 14 are connected by a transverse bar 17 which is provided with buffer coatings 18 and, during the emptying of relatively small containers, bears with these buffer coatings 18 against the container wall and prevents over-tipping of the relatively small containers in the opening 11 for dumping.

The novel hoisting/tipping device 20 comprises—as the drawing shows—two individual hoisting/tipping devices 20*a* and 20*b* which have the same construction and an arrangement which is symmetrical with respect to the vertical central plane of the dumping device 10. In view of the identical construction of the two individual hoisting/tipping devices 20*a* and 20*b*, only the construction of one of these individual hoisting/tipping devices is explained in the following text.

The two individual hoisting/tipping devices 20*a* and 20*b* have a common swivel shaft 21 which is divided in the middle zone and forms a swivel shaft part 21*a* and 21*b* for each individual hoisting/tipping device. A swivel arm 22 is fitted to each of these swivel shaft parts 21*a* and 21*b*. These swivel arms 22 consist of two swivel arm parts 22*a* and 22*b* which are fixed at a lateral spacing on the particular swivel shaft part 21*a* and 21*b* respectively, extend parallel to one another and receive a hoisting cylinder 23 between themselves.

Each of the swivel arms 22 carries a hoisting frame 24 which in each case consists of two vertical carrier parts 25*a* and 25*b*, to the upper end of which a hoisting bar 26 and to the lower end of which an abutment plate 27 is fitted. The hoisting bar 26 carries upward-extending tooth-like pick-up and carrier parts 28 and a centering insert 29 at its outer end, that is to say at its end pointing to the outside of the dumping device 10. The hoisting bars 26 and the abutment plates 27 of the two individual hoisting/tipping devices 20*a* and 20*b* are arranged in such a way that they are mutually aligned in the rest position, hoisting end position and tipping-in end position of the two individual hoisting/tipping devices 20*a* and 20*b*.

Coupling between the particular swivel arm 22 and the hoisting frame 24 is effected by means of an upper linkage pair 30*a*, 30*b* and a lower linkage pair 31*a*, 31*b*, the piston rod 23*a* of the particular hoisting cylinder 23 engaging on the lower linkage pair 31*a*, 31*b*. To retain and lock the container which has been picked up, a holding and locking strip 32 is rigidly mounted on each swivel shaft part 21*a* and 21*b* in a position vertically opposite the hoisting bar 26 and accordingly follows the swivel motion of each of the swivel arms 22.

To generate the swivel motion, a swivel drive 33 fitted with a pressure medium cylinder 34 is placed onto each swivel shaft part 21*a* and 21*b* from the particular outer side of the dumping device 10. Moreover, each swivel shaft part 21*a* and 21*b* carries on its outer end zone a swivel-limiting lever 35 which, in the tipping-in end position of the particular individual hoisting/tipping device 20*a* or 20*b*, engages on a limit buffer 36 which is fitted on the dumping housing and which—as shown in detail in FIG. 6—can be connected to a pressure compensation valve actuated by the swivel-limiting lever 35. To actuate the hoisting/tipping device, a hydraulic system is provided which comprises an actuating valve 37*a* and 37*b* for each individual hoisting/tipping device 20*a* and 20*b* and a shut-off and change-over valve 38 for selecting individual operation or common operation of the two individual hoisting/tipping devices 20*a* and 20*b*.

Figure 4:
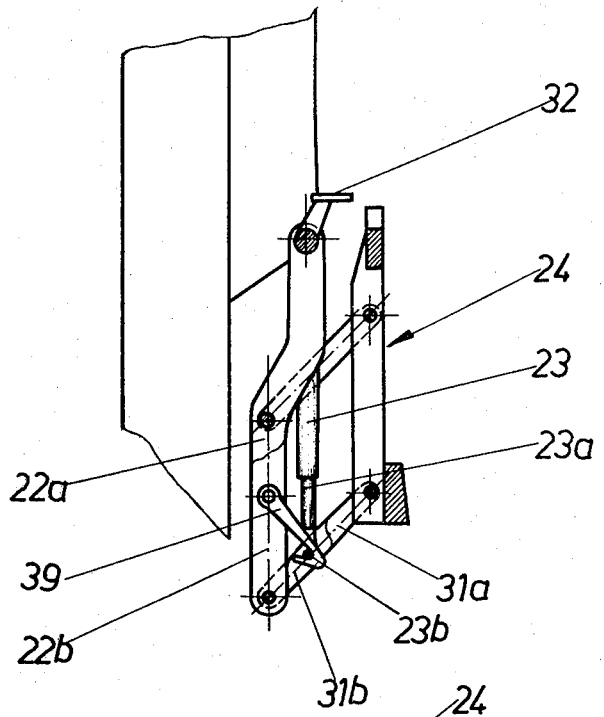
FIG. 4 shows a detailed representation of the locking, with the hoisting frame of a device according to FIG. 1 partially lifted.

As FIG. 4 shows, each individual hoisting/tipping device can further be equipped with a hook 39 for locking during a movement of the vehicle, which hook is pivotably mounted on the inside of a swivel arm part 22*a* and, in a partially raised position of the hoisting frame 24, is hung over the hinged bar 23*b* which connects the piston rod 23*a* of the hoisting cylinder 23 to the lower linkage pair 31*a*, 31*b*. Due to this safety device, the hoisting frame 24 cannot return to its lower rest position even if the pressure in the hoisting cylinder 23 is relieved. This raised and locked position of the hoisting frame 24 is particularly suitable for hoisting-/tipping devices fitted on refuse vehicles in order to hold the hoisting frame at a safe distance from the ground when the refuse vehicle is moving.

Figure 5:
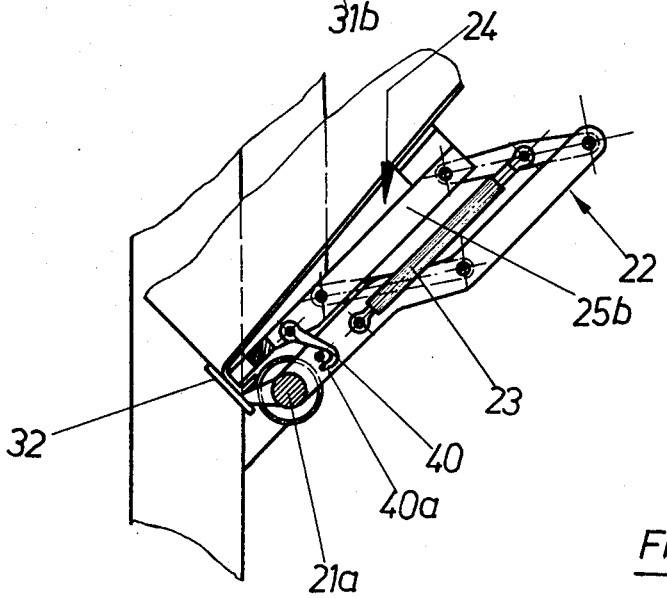
FIG. 5 shows a detail view of a hoisting frame in the tipping-in end position, with the pawl engaged.

According to FIG. 5, a further complementary safety provision is possible when a locking pawl 40 is pivotably mounted between the carriers 25*a* and 25*b* of the hoisting frame, which pawl pivots, under the action of its own weight, in the tipping-in end position of the particular individual hoisting/tipping device 20*a* or 20*b* in such a way that it engages around a bolt 40*a* fitted on the swivel arm 22 and thus prevents the hoisting frame 24 from lifting off the particular swivel arm 22 during the jarring movement, when the pressure in the hoisting cylinder 23 is relieved. Lifting-off can start only after the particular individual hoisting/tipping device 20*a* or 20*b* has swivelled back sufficiently far out of the opening 11 for dumping that the locking hook 40 frees the particular bolt 40*a*.

Figure 6:
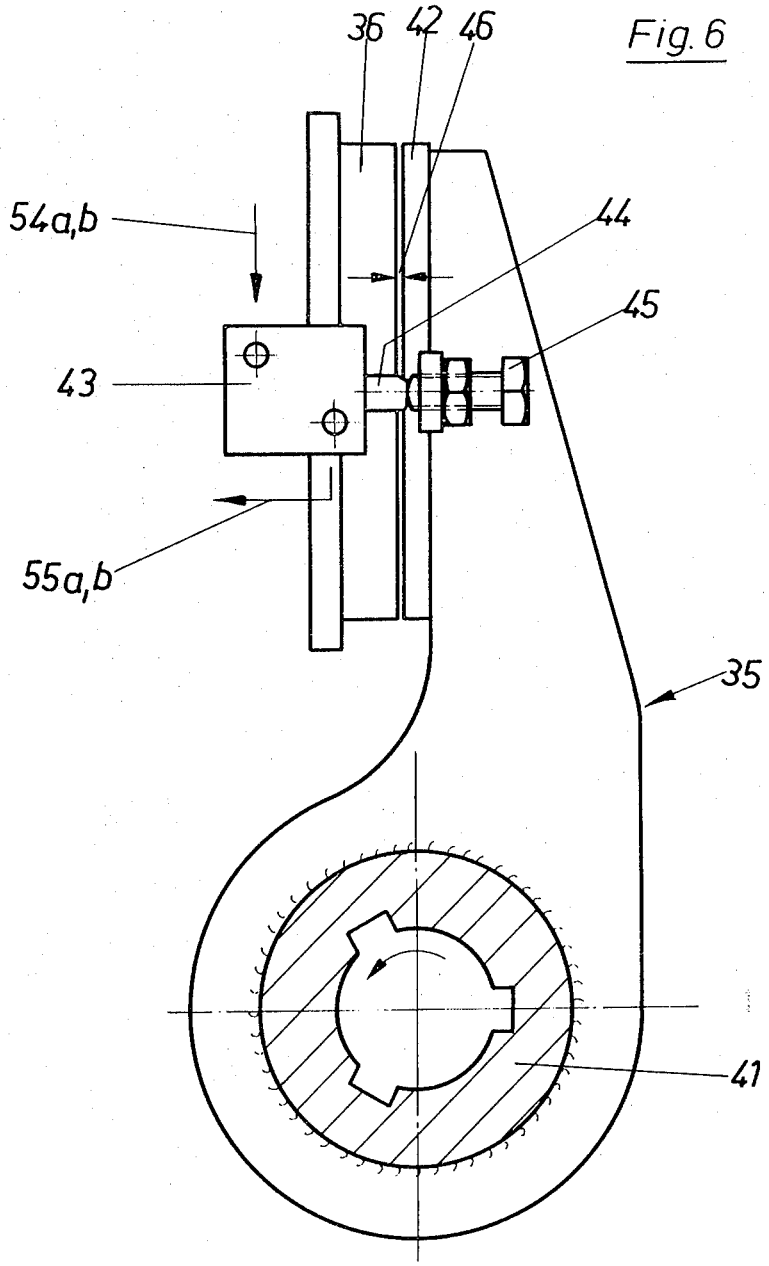

As FIG. 6 shows, each swivel-limiting lever 35 is rigidly joined to the end zone, formed as a splined hub 41, of the particular swivel shaft part 21*a* or 21*b* and is placed onto the output shaft, formed as a splined shaft or indexing shaft, of the particular swivel drive 33. At its end, the swivel-limiting lever 35 carries an abutment plate 42 which moves against an abutment buffer 36 on the dumping housing. The actuating member 44 of a pressure compensation valve 43 passes through the abutment buffer 36, for resetting the pressure compensation valve 43 against the action of a spring. To make it possible accurately to adjust the point in time when the pressure compensation valve 43 is changed over, the swivel-limiting lever 35 carries an adjusting screw 45 in the zone of its abutment plate 42. Adjustment can be carried out in such a way that the point in time when the pressure compensation valve 43 is changed over is reached when the abutment plate 42 is still at a small distance 46 from the abutment buffer 36. If appropriate, it is also possible to use the adjusting screw for arranging a jarring action by means of the pressure compensation valve.

Figure 7:
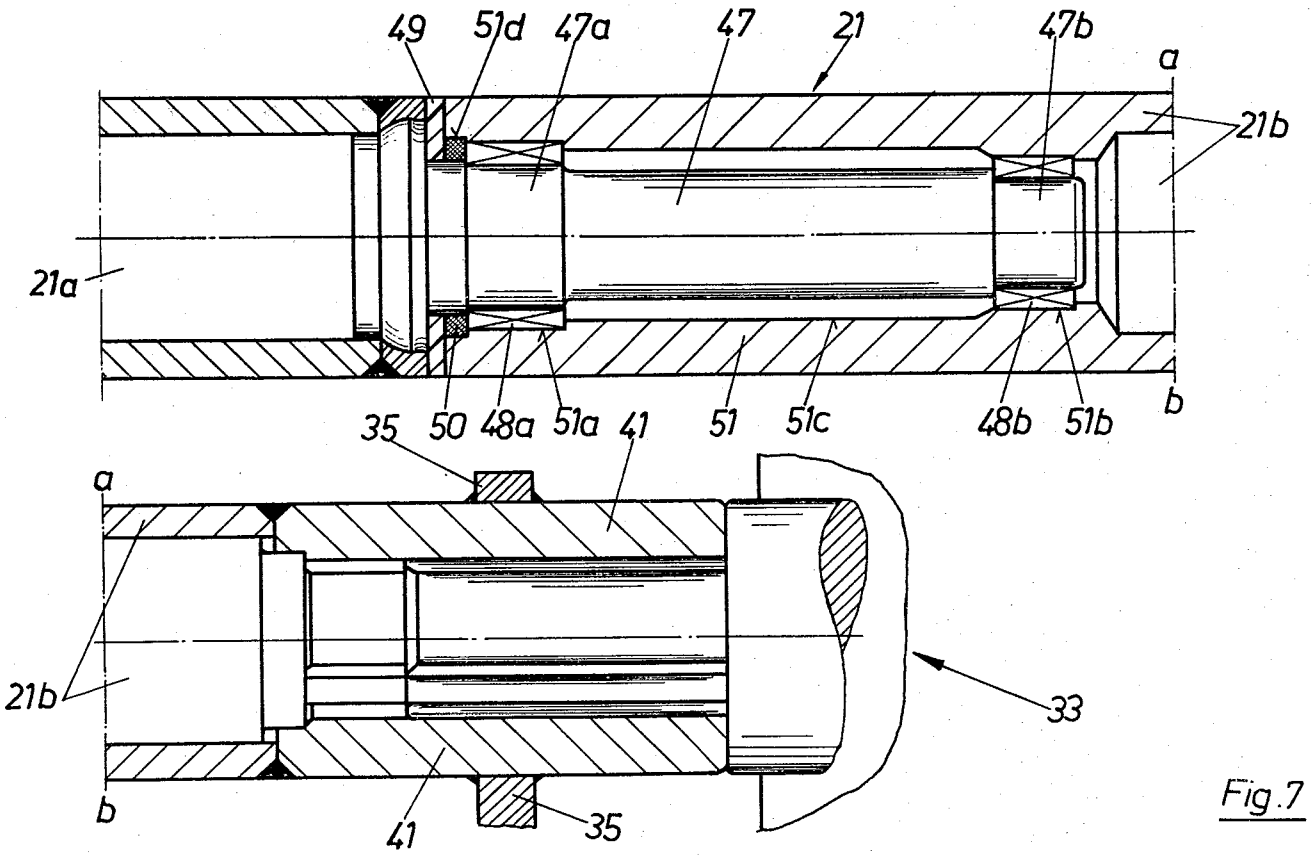
FIG. 7 shows a partial representation of the middle zone and of one end zone of the swivel shaft.

As can be seen from FIG. 7, the swivel shaft 21 can be formed as a hollow shaft. One swivel shaft part 21 carries, at its end located near the middle of the swivel shaft, a coupling and bearing journal 47 which is rigidly inserted axially into the end of the shaft part 21*a*. This coupling and bearing journal 47 has two cylindrical sections 47*a* and 47*b*, which are arranged at an axial spacing and of which the cylindrical section 47*b* of smaller diameter is located at the free end of the coupling and bearing journal 47. A needle bearing 48*a* and 48*b* is placed onto each of these cylindrical sections 47*a* and 47*b*. Between the needle bearing 48*a* and the swivel shaft part 21*a*, a plastic ring of the same external diameter as that of the swivel shaft part 21*a* and a radial seal ring 50 are also placed onto the coupling and swivel journal 47.

In the middle zone of the swivel shaft 21, the swivel shaft part 21*b* is formed as a receiver bush 51 for the coupling and swivel journal 47 and accordingly possesses a cylindrical bore section 51*a* for receiving the needle bearing 48*a* and a cylindrical section 51*b* for receiving the needle bearing 48*b*. Between these two cylindrical sections 51*a* and 51*b*, a section 51*c* is formed, the internal diameter of which is greater than the external diameter of that section of the coupling and sleeve journal 47 which is received by the section 51*c*. In this way, an annular space for receiving lubricant is formed and this is accessible from the outside through a lubrication nipple. A bore section 51*d*, which is even wider, for receiving the radial seal ring 50 and a smooth plane end face for bearing against the plastic ring 49 are formed at the free end of the receiving bush 51. The two swivel shaft parts 21*a* and 21*b* are held axially together by the seating of the needle bearing 48*a* and 48*b* and by the swivel drives 33 which are placed onto the swivel shaft 21 from either side and which are held on the dumping housing by means of flanges (compare FIG. 1).

Figure 8:
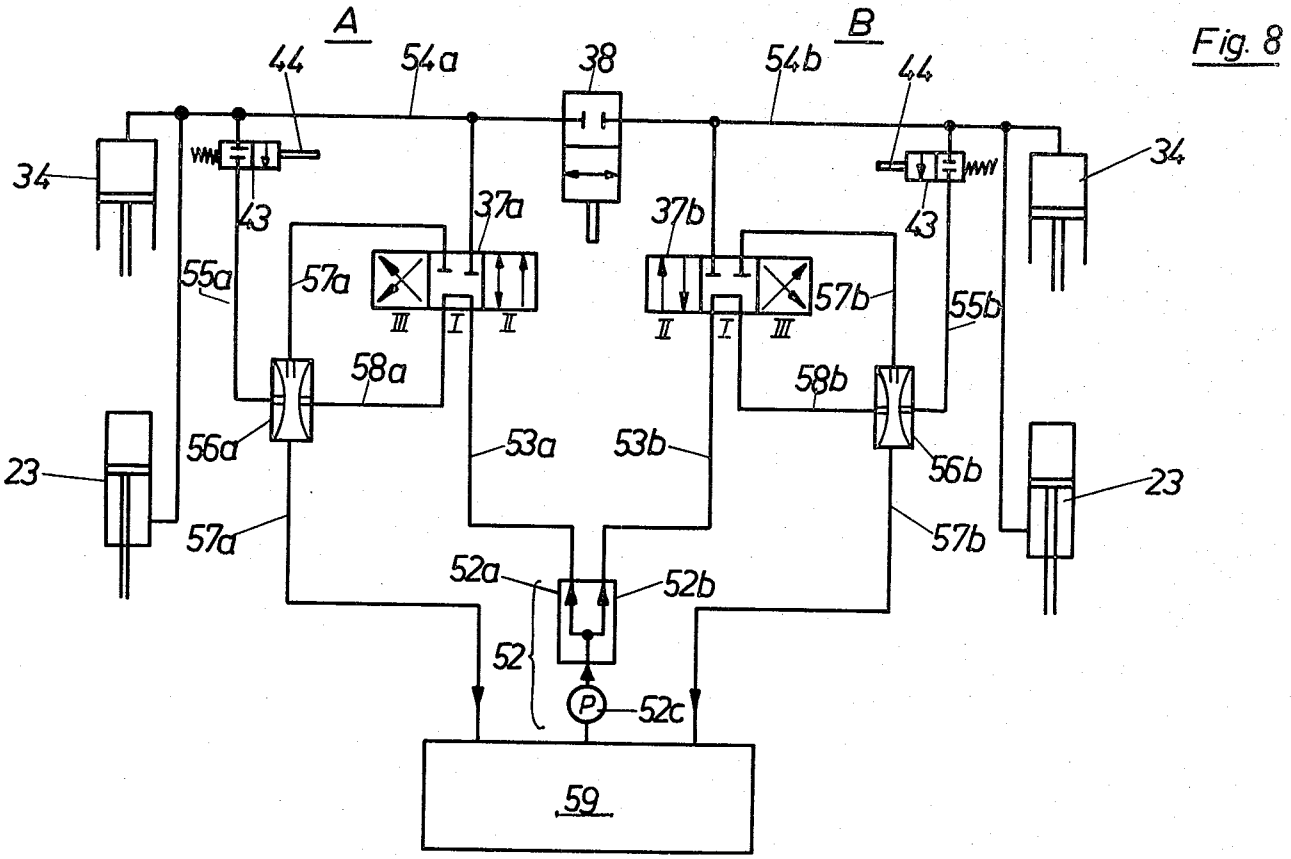
FIG. 8 shows a block diagram of the hydraulic drive and control system used in the device according to FIGS. 1 to 7.

As the diagram in FIG. 8 shows, a hydraulic pressure medium system which contains two pressure medium circuits A and B designed in the same way is provided for actuating and controlling the hoisting/tipping device according to FIGS. 1 to 7. Each of these pressure medium circuits A and B comprises a pressure medium source which, in the example shown, can be formed by a branch 52*a* or 52*b* respectively of a pressure-independent stream divider in conjunction with a pressure medium pump 52*c* located upstream of this stream divider. It is also possible, however, to form this pressure medium source by means of a twin pressure medium pump, of which one single pump is switched in each case to one of the pressure medium circuits A and B. In the pressure medium circuit A, a pressure medium forward line 53*a* or 53*b* leads from this pressure medium source 52, 52*a* to the particular control valve 37*a* or 37*b*. The particular pressure medium feed line 54*a* or 54*b* is connected to this control valve 37*a* or 37*b* respectively. The pressure medium feed line 54*a* leads to the cylinder 34 of the actuating drive 33 and to the hoisting cylinder 23 of the individual hoisting/tipping device 20*a*, which cylinders are connected in parallel, whilst the pressure medium feed line 54*b* leads, in a symmetrical arrangement, to the swivel drive cylinder 34 and the hoisting cylinder 23, which are connected in parallel, of the individual hoisting/tipping device 20*b*. A pressure compensation valve 43 with an actuating element 44 is connected to each of the pressure medium feed lines 54*a* and 54*b*. Pressure relief lines 55*a* or 55*b* lead, respectively, from these pressure compensation valves 43 to a pressure medium return flow valve 56*a* or 56*b*, which is inserted into the pressure medium return line 57*a* or 57*b* in order to improve the return flow of pressure medium and hence the return motion of the cylinder/piston units 23 and 34. Moreover, a pressure medium short-circuit line 58*a* or 58*b* leads from the control valve 37*a* or 37*b* to the particular pressure medium return flow valve 56*a* or 56*b*. The pressure medium return lines 57*a* and 57*b* lead into a pressure medium reservoir 59 from which the pressure medium pump 52*c* draws the quantity of pressure medium required for the system and introduces this quantity via the particular branch 52*a* or 52*b* of the stream divider into the pressure medium circuit A or the pressure medium circuit B respectively.

If desired, a shut-off and change-over valve 38 which can be brought into a shut-off position and a connecting position is inserted between the pressure medium feed lines 54*a* and 54*b*.

In the representation in FIG. 8, the shut-off and change-over valve 38 is in the shut-off position and the control valves 37*a* and 37*b* are in the neutral position. With this valve position, the pressure medium coming from the pressure medium source 52*a* flows in the pressure medium circuit A via the pressure medium forward line 53*a* and the passage, formed by the control valve 37*a* in the neutral position, to the short-circuit line 58*a* and passes from there through the return flow valve 56*a* into the return line 57*a* and from there back to the pressure medium reservoir 59. Analogously, but independently of the pressure medium circuit A, the flow in the pressure medium circuit B proceeds from the pressure medium source 52*b* via the pressure medium forward line 53*b*, the control valve 37*b*, the short-circuit line 58*b* and the return flow valve 56*b* into the return line 57*b* and from there back to the pressure medium reservoir 59. When the control valve 37*a* is brought into the working position, the pressure medium in the pressure medium circuit A flows from the pressure medium source 52*a* via the pressure medium forward line 53*a* to the pressure medium feed line 54*a* and from there to the cylinder/piston units 23 and 34. The piston cross-sections of these two units are matched to one another in such a way that, corresponding to the initial output to be provided by the particular unit, the hoisting cylinder 23 is designed for a higher power than the swivel drive cylinder 34. Thus, the cylinder 23 is actuated first until the hoisting step is almost complete and, as a result of the slight pressure increase which thus occurs, the tipping step is initiated by means of the swivel drive cylinder 34. In the tipping-in end position, the adjusting screw 45 of the swivel-limiting lever 35 then strikes the actuating member 44 of the pressure compensation valve 43 (compare FIG. 6). The pressure compensation valve 43 which up to now has been in the closed position is then brought into a partially open position against the action of its setting spring so that a pressure relief takes place in the pressure medium feed line 54*a* via the pressure relief line 55*a* towards the pressure medium return flow valve 56*a*. If the control distance 46 between the actuation of the pressure compensation valve 43 and the final contact of the swivel-limiting lever with the abutment buffer 36 is set sufficiently narrow, the pressure relief taking place in the pressure medium feed line 54*a* will only be such that the residual pressure is adequate for holding the individual hoisting-/tipping device, together with the vessel to be emptied, in the tipping-in end position. If, however, the control distance 46 is set wider so that the adjusting screw 45 strikes the actuating element 44 of the pressure compensation valve 43 earlier, the pressure compensation valve 43 is opened so far that an extensive pressure drop occurs in the pressure medium feed line 54*a*. This extensive pressure drop in the medium causes the individual hoisting/tipping device, together with the container to be emptied, to swivel back for such a distance that the pressure compensation valve is closed again. It is possible in this way, by continuous actuating and releasing of the pressure compensation valve 43, to induce a kind of jarring motion by means of the swivel-limiting lever 35.

To swivel a container back and to set it down, the control valve 37*a* must be brought into its return flow position III. In this position, the pressure medium forward line 53*a* is connected to the return line 57*a* and the pressure medium feed line 54*a* is connected to the short-circuit line 58*a*. The pressure medium coming from the pressure medium source 52*a* via the pressure medium forward line 53*a* then flows off through the return flow valve 56*a*, exerting a suction effect on the short-circuit line 58*a* (Venturi design), in order not only to cause the pressure medium thus to run out of the pressure medium feed line and out of the cylinders 23 and 24 but also to draw it off, in particular until the emptied container has been set down.

This working step in the pressure medium circuit A has no influence whatsoever on the pressure medium circuit B, and in particular neither on the pressure build-up in the pressure medium circuit B nor on the quantity of pressure medium which may be flowing in the pressure medium circuit B.

When the actuation of the control valve 37*b* in the pressure medium circuit B for the individual hoisting-/tipping device 20*b* is carried out in a manner corresponding to that explained above, the corresponding working steps take place in the pressure medium circuit B, without acting back on the pressure medium circuit A.

When the shut-off and change-over valve 38 is brought into the connecting position, a direct connection between the pressure medium feed lines 54*a* and 54*b* is made, and this amounts to switching all the cylinder/piston units 23 and 34 of the entire hoisting/tipping device 20 in parallel. When the control valve 37*a* is then brought into the working position, both pressure medium feed lines 54*a* and 54*b* are then charged from the pressure medium source 52*a* via the pressure medium forward line 53*a*. This means that both hoisting cylinders 23 and both swivel drive cylinders 34 are then charged with a flow rate of pressure medium which is the same as for only one hoisting cylinder 23 and one swivel drive cylinder 34 in the case of individual control. The working speed of the entire hoisting/tipping device is here only about half that of the individual hoisting/tipping device 20*a* or 20*b* when controlled individually.

The same mode of working of the entire hoisting/tipping device 20 is also achieved when actuating the control valve 37*b*, except that in such a case the pressure medium source 52*b* and the pressure medium forward line 53*b* are switched to both pressure medium feed lines 54*a* and 54*b*. With the entire hoisting/tipping device 20 in operation, both pressure compensation valves 43 are actuated in the tipping-in end position.

In the example of FIGS. 1 and 8, a single shut-off and change-over valve 38 is provided which is located on one side of the emptying device. Instead, it would also be possible to provide two shut-off and change-over valves, specifically one of each on each side of the emptying device. These two shut-off and change-over valves would then have to be designed in an analogous manner and to be arranged in the hydraulic system in a way, such as is known, for example, for electrical two-way switches in electric lighting installation units. It would then be possible to use any desired shut-off and change-over valve for changing the device over from one mode of operation to the other.

The invention can also be carried out using a pneumatic pressure medium system.

What is claimed and desired to be secured by Letters Patent is:

1. In a construction of the kind described for emptying refuse containers of different sizes into collecting containers of refuse vehicles, in combination:

(a) two individual container-handling devices provided side by side and adapted to be actuated either separately or else together as desired, (b) each one of said individual devices having means for picking up a container to be emptied, and being capable of picking up a container when operating in tandem, (c) two individual, essentially identical pressure-medium operated motors for operating said devices, (d) two essentially identical pressure-medium circuits (A,B), each one of which is connected to one of said pressure-medium motors and each one of said circuits (A, B) containing a three-position control valve operable to effect either a neutral condition, a pressure stroke or a return stroke, (e) two pressure-medium feed lines leading from the respective control valves to the respective pressure-medium operated motors, and (f) means for interconnecting and disconnecting the two said pressure medium circuits (A, B) as desired, said means including a shut-off and change-over valve (38) connected between the said respective pressure-medium feed lines of the said two pressure-medium circuits (A, B), (g) said interconnecting means providing for substantially one-half the flow rate to said pressure-medium operated motors when only one of said three-position control valves is placed in pressure-stroke position.

2. A construction according to claim 1, characterized in that one pressure compensation valve (43) is provided in each of the pressure medium feed lines (54*a*, 54*b*) leading to the pressure medium-operated motors (23, 24) of the pressure medium circuits (A, B), which pressure compensation valves are actuated when the device reaches a limit in its emptying movement.

3. A construction according to claim 2, characterized in that the pressure medium system is hydraulic and each pressure compensation valve (43) connects the particular pressure medium feed line (54*a* or 54*b*) to the pressure medium return line (57*a* or 57*b* respectively) of the particular pressure medium circuit (A, B).

4. A construction according to claim 2, characterized in that the pressure medium system is hydraulic and has pressure medium sources (52*a*, 52*b*) pressure medium forward lines (53*a*, 53*b*) and pressure medium return lines (57*a*, 57*b*) the control valves (37*a*, 37*b*) short circuiting in their neutral-conditions, said pressure medium forward lines (53*a*, 53*b*) coming from the pressure medium sources (52*a*, 52*b*) of the particular pressure medium circuits (A, B) to the pressure medium return lines (57*a* or 57*b*).

5. A construction according to claim 4, characterized in that one return flow valve (56*a*, 56*b*) is inserted into each of the pressure medium return lines (57*a*, 57*b*) of each pressure medium circuit (A, B); a pair of pressure compensation valves (43) and a pair of pressure medium short-circuit lines (58*a*, 58*b*) which latter comes from the control valves (37*a*, 37*b*) are also connected respectively to return flow valves.

6. A construction according to claim 1, characterized in that a pressure medium pump (52*c*) common to both pressure medium circuits (A, B) and a branched pressure-dependent stream divider are provided, one branch (52*a*) of the stream divider forming the pressure medium source for one pressure medium circuit (A) and another branch (52*b*) forming the pressure medium source for the other pressure medium circuit (B).

7. A construction according to claim 1, characterized in that a common swivel shaft (21), divided in the middle, is provided for the two individual devices (20*a*, 20*b*), said motors being connected to the pressure medium circuits (A, B) respectively and being fitted on each end of said swivel shaft (21); a sleeve and journal coupling (47), (51) is provided coaxially engaging one part (21*a*) of the shaft with the other part (21*b*) of the shaft, said coupling being located substantially in the middle of the swivel shaft (21).

8. A construction according to claim 7, characterized in that a swivel-limiting lever (35) moving towards a stop (36), is provided and fitted on each end of the swivel shaft (21) in the zone of the drive shaft of the particular pressure medium-operated motor (33, 34).

9. A construction according to claim 8, characterized in that the swivel-limiting lever (35) constitutes an actuating device for interaction with the particular pressure compensation valve (43).

10. A construction according to claim 9, characterized in that an adjustable actuating element (45) which engages an actuating member (44) of the pressure compensation valve (43) is provided, on the swivel-limiting lever (35).

11. A construction according to claim 1, characterized by said construction having dumping openings (11), and further having a resiliently yielding, tipping-in back stop (13 to 18) for the containers which are to be dumped in the openings (11).

12. A construction according to claim 11, characterized in that the tipping-in back stop is provided with spring-biased levers (14) which are pivotable into the opening (11) for dumping, against the action of spring means and is provided with hook-like lower ends (15) which constitute a lid-opening device for any containers having a cylindrically domed lid and lid-actuating elements mounted on the side.

13. A construction according to claim 1, wherein each container-handling device includes a hoisting and tilting frame having a swivel drive, an additional pressure-medium-operated motor for actuating the swivel drive (33, 34), said first-mentioned pressure medium-operated motors actuating the hoisting frame (24), the two pressure medium-operated motors belonging to one individual container-handling device (20*a* or 20*b*) being arranged in parallel in the same pressure medium circuit (A or B respectively) and the working surfaces thereof which are subjected to the pressure medium being matched to one another to give a desired time sequence to their working strokes.

14. A construction according to claim 13, characterized in that the hoisting frame (24) of each individual container-handling device (20*a*, 20*b*) has a four-bar linkage (30*a*, 30*b*, 31*a*, 31*b*), said swivel shaft (21) having a swivel arm (22) connected to said linkage.

15. A construction according to claim 14, characterized in that the hoisting frames (24) have locking pawls (40) which swivel under the action of their weight and which, in the tipping-in end position of the particular individual container-handling device (20*a* or 20*b*), engage as locking elements with the swivel arms (22) of the swivel shafts (21).

16. A construction according to claim 14, characterized in that hooks (39) are provided for locking, during a movement of the vehicle, the partially raised hoisting frames (24), said hooks being fitted on the swivel arms

(22) of each individual container-handling device (20*a*, 20*b*).

17. A construction according to claim 15, characterized in that the hoisting frames (24) of each individual container-handling devices (20*a*, 20*b*) have pick-ups engaging with corresponding elements of the containers to be emptied, said pick-ups being mutually aligned in the rest position, the hoisting end position and in the tipping-in end position.

18. A construction according to claim 17, characterized in that the pick-up (26, 28) of each individual container-handling device (20*a*, 20*b*) has on its outer end a lateral projection (29) for centering the containers to be emptied.

* * * * *